US007648090B2

(12) United States Patent
Ahlgren et al.

(10) Patent No.: US 7,648,090 B2
(45) Date of Patent: Jan. 19, 2010

(54) DISC HOUSING

(75) Inventors: Örjan Ahlgren, Sundsvall (SE); Anders Mattsson, Alnö (SE)

(73) Assignee: Metso Panelboard AB (SE)

( * ) Notice: Subject to any disclaimer, the term of this patent is extended or adjusted under 35 U.S.C. 154(b) by 59 days.

(21) Appl. No.: 11/887,987

(22) PCT Filed: Apr. 6, 2006

(86) PCT No.: PCT/SE2006/000413

§ 371 (c)(1),
(2), (4) Date: Oct. 5, 2007

(87) PCT Pub. No.: WO2006/112769

PCT Pub. Date: Oct. 26, 2006

(65) Prior Publication Data

US 2009/0057454 A1 Mar. 5, 2009

(30) Foreign Application Priority Data

Apr. 18, 2005 (SE) ..... 0500892

(51) Int. Cl.
*B02C 23/20* (2006.01)

(52) U.S. Cl. ..... 241/60; 241/261.3

(58) Field of Classification Search ..... 241/60, 241/261.2, 261.3
See application file for complete search history.

(56) References Cited

U.S. PATENT DOCUMENTS

| | | | | |
|---|---|---|---|---|
| 4,270,976 | A * | 6/1981 | Sandstrom et al. | 162/26 |
| 4,878,997 | A * | 11/1989 | Reinhall | 162/23 |
| 6,364,998 | B1 * | 4/2002 | Sabourin | 162/23 |

FOREIGN PATENT DOCUMENTS

| | | |
|---|---|---|
| DE | 815 291 C | 10/1951 |
| GB | 1 295 731 A | 11/1972 |
| WO | WO-85/04431-AI | 10/1985 |

* cited by examiner

*Primary Examiner*—Bena Miller
(74) *Attorney, Agent, or Firm*—Lerner, David, Littenberg, Krumholz & Mentlik, LLP

(57) ABSTRACT

A disc housing intended for refiners with refining discs rotating in opposed directions relative to each other is disclosed for mechanically disintegrating and working fibrous material. The disc housing surrounds the refining discs in an air-tight manner, and is provided with an outlet for the worked fibrous material. The inside of the disc housing along its periphery is formed with a channel, which, as seen in the circumferential direction, has a continuously increasing radius, which increases all the way to the outlet, which is located tangentially as a direct continuation of the channel.

3 Claims, 2 Drawing Sheets

DISC HOUSING

FIELD OF THE INVENTION

The present invention relates to refiners of the disc-type, with refining discs rotating in opposite directions relative to each other. The refining discs are provided with refining segments, which between themselves form a refining gap with a refining zone for the mechanical disintegration and working of the fibrous material, which is preferably lignocellulosic. The refining gap is used for the manufacture of, for example, reject pulp, recycled fiber pulp and mechanical pulps such as board pulp, thermomechanical pulp (TMP) and chemi-thermomechanical pulp (CTMP). The refining discs are surrounded by an air-tight disc housing, which allows the fibrous material to be fed in centrally through one of the refining discs. After its passage through the refining gap the worked material flows out into the disc housing, from where it is led further via a blow valve to subsequent process stages.

BACKGROUND OF THE INVENTION

The mechanical disintegration and working of this fibrous material requires energy, which is supplied by means of the refining elements on the refining discs. During the refining, the supplied energy is transformed substantially to heat, with the result that the water following along with the fibrous material evaporates and is emitted from the worked material. The main part of the steam flows out into the disc housing, where pressure is maintained by means of a blow valve.

Due to the rotation of the refining disc, the worked material will be thrown about in the disc housing before the fibrous material, together with the steam, leaves the disc housing through the blow valve. This turbulent flow of the fibrous material in the disc housing increases the energy consumption and causes wear on the rotating as well as the stationary parts of the disc housing. Fiber build-up and extractive matter on the inside of the disc housing brake the flow and can block the outflow through the blow valve, which results in higher energy consumption and increases the development of steam.

The present invention relates to a disc housing for refiners which is designed to overcome the aforesaid problems and improve the fiber flow in the disc housing.

SUMMARY OF THE INVENTION

In accordance with the present invention, these and other objects have now been realized by the invention of a refiner housing including a pair of relatively rotatable refiner discs juxtaposed with each other therein for refining fibrous material therebetween, the refiner housing including an outer periphery, an outlet for the refined fibrous material tangential to the inner surface of the outer periphery of the refiner housing, a channel formed within the outer periphery of the refiner housing, the channel having a continuously increasing radius along its circumferential direction up to a maximum radius at the outlet, and a blow valve associated with the outlet for controlling the flow of the refined fibrous material out of the refiner housing, the blow valve including an adjustable opening disposed at a location limited to a location directly facing the channel as seen from the radial direction thereof. Preferably, the increasing radius along the circumferential diameter direction of the channel comprises a widening channel within the outer periphery of the refiner housing. In a preferred embodiment, the channel includes a rounded base portion, preferably as seen in cross-section thereof.

In accordance with one embodiment of the present invention, the inside of the disc housing, along its periphery, is formed with a channel, the radius of which increases continuously in the circumferential direction outside the opening of the refining gap in the disc housing. The radius thus increases continuously all the way to the outlet to the blow valve. This outlet is located tangentially so that it is a direct continuation of the channel. The disc housing can be suitably designated with the channel as an all around widening outside the opening of the refining gap in the disc housing. The blow valve can be formed with an adjustable opening only directly in front of the outer portion, as seen radially, of the channel.

By this design of the disc housing great advantages are achieved. The material flow out from the refining gap is collected in the disc housing and follows the channel on the inside of the disc housing toward the outlet to the blow valve. The material flow thereby becomes more uniform, and it has thus been found that the energy consumption can be reduced by more than 25-50 kWh/tons of fiber. By concentrating the fiber flow to a channel along the inner periphery of the disc housing, can the wear on the various parts in the disc housing can be reduced, and the risk of fiber-build-up and disturbances resulting therefrom is decreased. The rotating refining disc (rotator) of the refiner will now rotate in a thinner medium, because the fibrous material follows the channel instead of forming a thick atmosphere of steam, water and fiber in the entire disc housing. The design of the blow valve implies that the valve opening can be adopted to the fiber flow in the channel along the periphery of the disc housing. Flow obstacles can be prevented and the risk of clogging thereby be reduced.

A further advantage of the present invention during the manufacture of board pulp is that the uniform flow of fibrous material in the disc housing and out through the blow valve renders possible a better controlled and thereby reduced size addition.

BRIEF DESCRIPTION OF THE DRAWINGS

The present invention is described in greater detail in the following detailed description, with reference to the accompanying drawings, in which.

DETAILED DESCRIPTION

Figure 1:
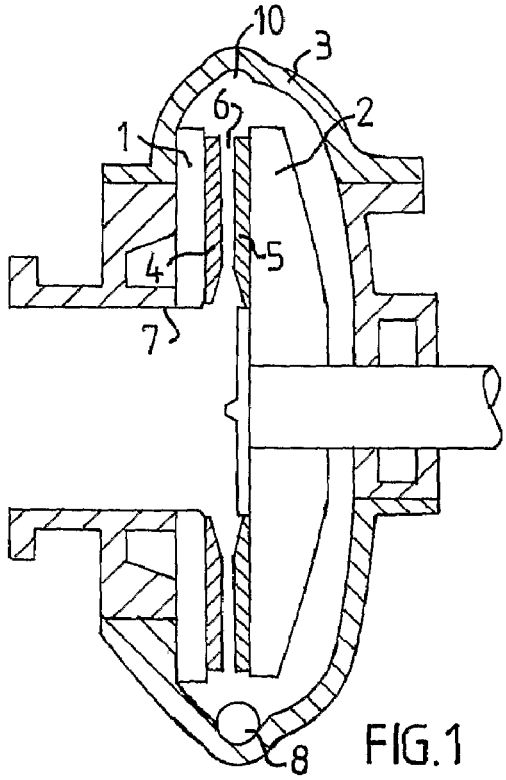
FIG. 1 is a side, elevational view of a refiner with a disc housing according to the present invention.
Figure 2:
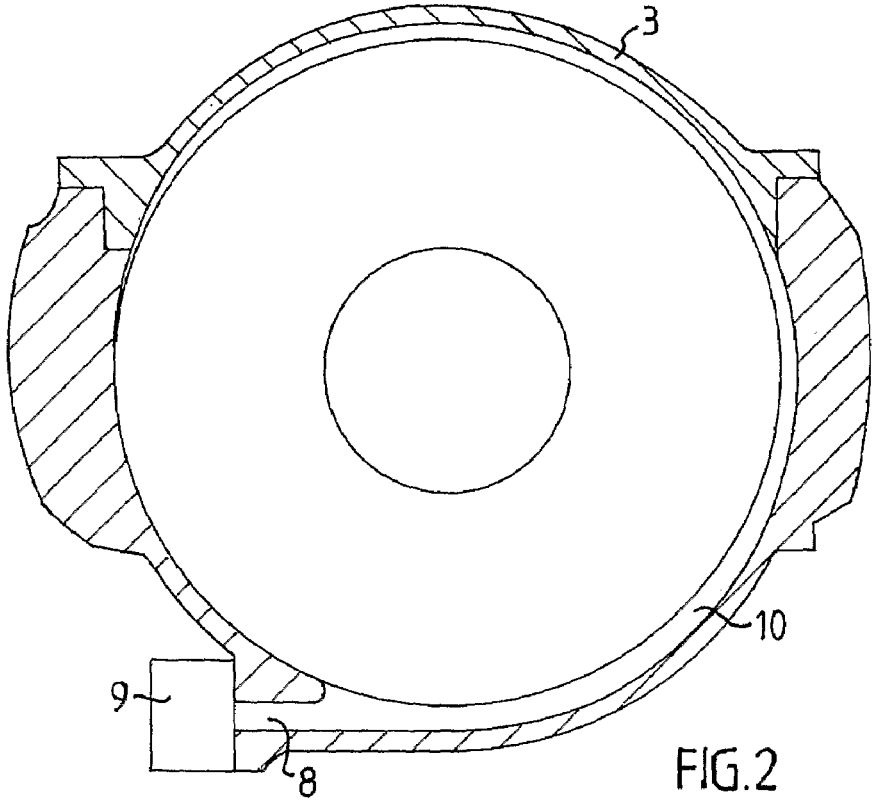
FIG. 2 is a front, elevational, cross-sectional view of a disc housing according to the present invention.
Figure 3:
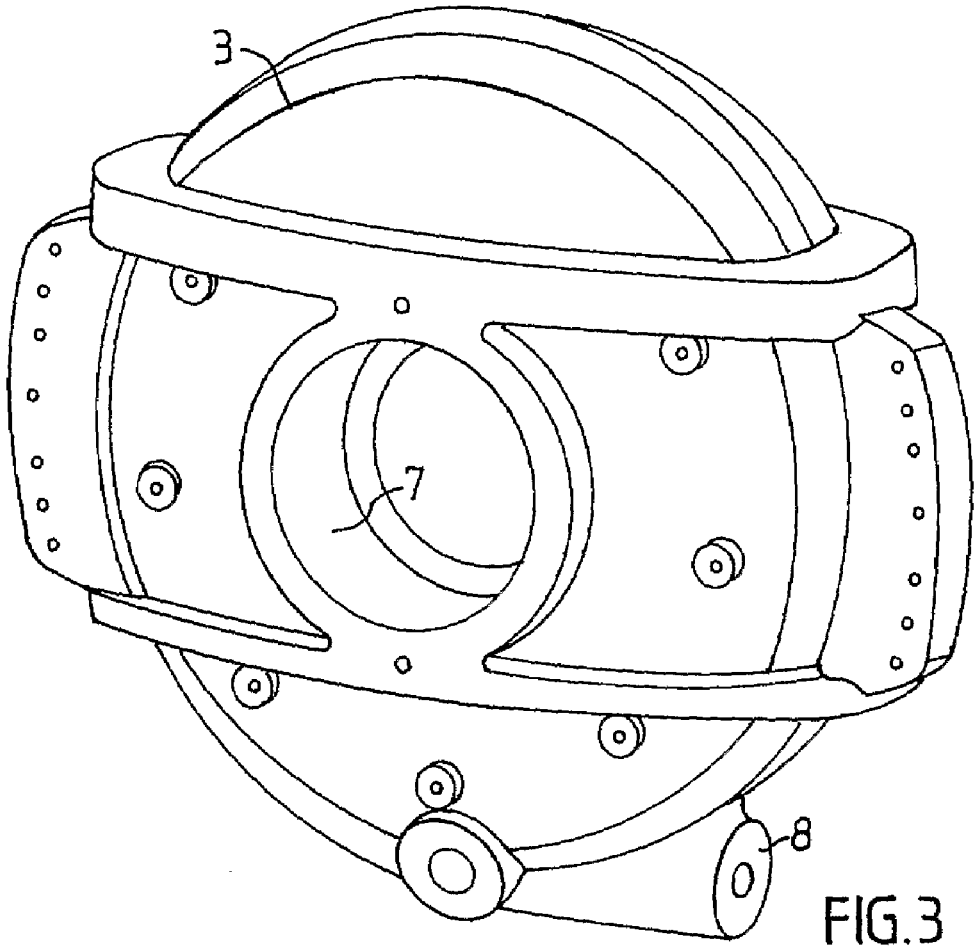
FIG. 3 is a front, perspective view of the disc housing according to the present invention from the outside.
Figure 4:
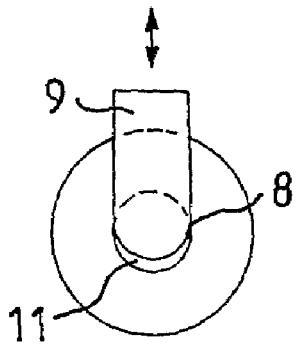
FIG. 4 is a front, elevational, schematic view of a blow valve for the disc housing according to the present invention.

Turning to the Figures, FIG. 1 shows a disc refiner comprising a stationary refining disc (stator) 1 and a rotary refining disc (rotator) 2 mounted in a disc housing 3. Refining segments, 4 and 5, are attached to the stator and rotator, respectively. The refining segments, 4 and 5, form between themselves a refining gap 6. An opening 7 is provided for feeding the fibrous material through the stator 1 to the gap between the refining segments, 4 and 5. The disc housing 3 is provided with an outlet 8 and a blow valve 9 for controlling the pressure in and the flow out of the disc housing. The inside of the disc housing, along its periphery, is formed with a channel 10, the radius of which increases continuously in the circumferential direction outside of the opening of the refining gap 6 in the disc housing 3. The channel 10 extends along at least half the circumference of the disc housing, all the way to the outlet 8. The channel 10 is suitably located directly in front of the refining gap 6 between the refining segments, 4 and 5. The outlet 8 is located tangentially as a direct continuation of the channel 10. The channel 10 in the disc housing is suitably formed, as seen in cross-section, with a rounded bottom. The channel is thereby formed as a widening in the circumference of the disc housing.

The blow valve 9 is suitably formed with an adjustable opening 11 only directly in front of the outer portion of the channel 10, as seen radially. The valve is provided with a slidable or rotary cover, which can cover the cross-section of the valve opening and leave an adjustable gap opening in only the outer portion of the cross-section.

The fibrous material, for example in the form of wood chips to be disintegrated and worked in the refiner, is supplied through the opening 7 in the disc housing 3 and stator 1, suitably by means of a screw feeder (not shown). The fibrous material is treated thereafter in the refining gap 6 where it is disintegrated and worked to fiber pulp in the refining gap 6 between the refining segments, 4 and 5, rotating relatively in opposed directions, and then flows out into the disc housing. The rotation of the rotor 2 and the created centrifugal force cause the fiber pulp to be collected in and be transported along the channel 10. Due to the design of the channel, the pulp will be moved to the outlet 8 as a uniform flow and will not gyrate about in the disc housing. As mentioned above, this implies that the energy consumption of the refiner can be substantially reduced, and the quality of the pulp can be improved. Furthermore, the wear on the parts in the disc housing decreases and the risk of fiber build-up and clogging is reduced.

The design of the blow valve 9 implies that the pulp flow out through the valve is facilitated, because the gap-shaped opening 11 can be adapted to the pulp flow along the bottom of the channel 10.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A refiner housing including a pair of relatively rotatable refiner discs juxtaposed with each other therein for refining fibrous material therebetween, said refiner housing including an outer periphery, an outlet for said refined fibrous material tangential to the inner surface of said outer periphery of said refiner housing, a channel formed within said outer periphery of said refiner housing, said channel having a continuously increasing radius along its circumferential direction up to a maximum radius at said outlet, and a blow valve associated with said outlet for controlling the flow of said refined fibrous material out of said refiner housing, said blow valve including an adjustable opening disposed at a location limited to a location directly facing said channel as seen from the radial direction thereof.

2. The refiner housing of claim 1 wherein said continuously increasing radius along the circumferential direction of said channel comprises a widening channel within said outer periphery of said refiner housing.

3. The refiner housing of claim 1 wherein said channel includes a rounded base portion.

* * * * *